United States Patent [19]

Grolla

[11] 4,036,283

[45] July 19, 1977

[54] RAIL CONVEYOR FOR FOUNDRY MOLDING BOXES

[75] Inventor: Herbert Grolla, Laasphe, Westphalia, Germany

[73] Assignee: Heinrich Wagner Maschinenfabrik, Laasphe, Westphalia, Germany

[21] Appl. No.: 707,613

[22] Filed: July 22, 1976

Related U.S. Application Data

[63] Continuation-in-part of Ser. No. 550,428, Feb. 18, 1975, abandoned.

[30] Foreign Application Priority Data

Mar. 1, 1974 Germany ..... 2409851

[51] Int. Cl.[2] ..... B22C 15/22

[52] U.S. Cl. ..... 164/160; 164/255; 164/324

[58] Field of Search ..... 164/7, 61, 63, 65, 130, 164/160, 255, 323, 324, 253, 254; 425/388

[56] References Cited

U.S. PATENT DOCUMENTS 3,832,117 8/1974 Hijikota et al. ..... 164/7 X 3,843,301 10/1974 Hijikota et al. ..... 164/160 X

*Primary Examiner*—Ronald J. Shore

*Attorney, Agent, or Firm*—Blanchard, Flynn, Thiel, Boutell & Tanis

[57] ABSTRACT

An improvement in a rail conveyor apparatus. The improvement is composed of a plurality of rail conveyor trucks coupled together and movably supported on a track with at least one foundry molding box being mounted on each rail conveyor truck. Each of the foundry molding boxes has a connector member thereon having first and second ends. A conduit connects the first ends of the connector members on each of the rail conveyor trucks. A vacuum source and another conduit is provided for coupling the vacuum source to a pair of coupling members. Valves are provided in the second-mentioned conduit for alternately connecting the coupling members to the vacuum source. Coupling devices are provided for effecting a coupling of at least one of the coupling members to the second end of one of the connector members on one of the conveyor trucks prior to an uncoupling of the other of the coupling members from the second end of another connector member on another rail conveyor truck. A drive device is provided for driving at least one of the pair of coupling members in timed sequence with the movement of the rail conveyor trucks so that a vacuum is provided in the first-mentioned conduit for the period of time that the coupling device couples the one coupling member to the one connector member to continuously maintain the vacuum source in coupled relation to the first-mentioned conduit.

5 Claims, 2 Drawing Figures

RAIL CONVEYOR FOR FOUNDRY MOLDING BOXES

CROSS REFERENCE TO RELATED APPPLICATION

This is a continuation-in-part of appplication Ser. No. 550 428, filed Feb. 18, 1975, now abandoned.

FIELD OF THE INVENTION

This invention relates to a closed circuit rail conveyor having a plurality of rail conveyor trucks coupled together to receive foundry molding boxes connected to vacuum pipes.

BACKGROUND OF THE INVENTION

The use of disposable patterns consisting of films is known from German Offenlegungsschfirt No. 1,926,163. For the production of these patterns the films are shaped to correspond to the required casting by means of a known deepdrawing shaping process utilizing reduced or elevated pressure. The patterns are provided with a rim which extends therearound and which lies in the mold divison plane, this rim lying on the edge of the foundry molding box (also known as a mold member) after the pattern has been introduced into the latter. The foundry molding box is then filled with loose, binderless sand. In the case of a frame-like molding box, a film is also laid on the opposite side of the molding box and the interior of the latter is then evacuated. Through the external air pressure applied to the films, the latter are pressed against the sand. In this way it is possible to produce patterns of stable shape from very thin films. This known method of molding is decidedly advantageous because the production of the patterns entails only little expense, a casting having a very smooth surface is obtained, and no preparation of the sand is requried. All that is required to remove the casting from the mold is to terminate the reduced pressure in the foundry molding box.

A prerequisite for the application of the process described above is that the reduced pressure in the foundry molding box should be maintained from the time when the patterrn is complete until the casting has completely cooled. In order to make this possible, it is known for the foundry molding box, that is to say the upper and lower parts of the box, to be provided with the individual flexible vacuum pipes. For individual production this does not constitute a great disadvantage, although manipulation of the molding boxes is limited.

For continuous production the molding boxes are placed on trucks of a closed-circuit rail conveyor which brings the molding boxes to the individual stations. The major part of the time required for one circuit of a rail conveyor truck, that is to say for the production of a casting is required for the cooling of the casting. The longer the rail conveyor, the longer the cooling time available for the same cycle sequence. In known rail conveyors, in which the foundry molding boxes are connected to vacuum pipes, the length of the rail conveyor is however mainly limited by the possible length of the vacuum pipes. These pipes, which must be of flexible construction in order to enable the molding boxes to be manipulated, have been found liable to breakdown and to be a very great hindrance. It is known for a rail conveyor to be made in the form of a circle and for all the vacuum pipes associated with the molding boxes to be joined to a centrally disposed vacuum pipe. These known rail conveyors have the additional disadvantage that they require considerable space.

It is an object of the invention so to construct a rail conveyor of the kind first-mentioned above that it can be made of any desired length, that it can be in the form of a space-saving arrangement, and that unrestricted manipulation of the foundry molding boxes is retained.

According to the invention there is provided a rail conveyor having a plurality of rail conveyor trucks coupled together to receive foundry molding boxes connected by vacuum pipes, characterized in that each rail conveyor truck is connected by a vacuum pipe to the two neighboring rail conveyor trucks coupled to it, that a foundry molding box placed on a rail conveyor truck is adapted to be coupled by a connector to the vacuum pipe of the rail conveyor truck and that the vacuum pipe connecting the rail conveyor trucks is provided at predetermined intervals with couplings, which are closed by non-return valves for the intermittent connection of at least one vacuum pipe connected to a vacuum pump. At predetermined intervals the vacuum pipe of the rail conveyor truck is provided with couplings for the connection of an evacuation pipe, which is connected to a vacuum pump. This evacuation pipe is intermittently connected, in dependence on the timed advance of the rail conveyor trucks, to the couplings disposed one behind the other. The evacuation pipe therefore does not need to follow the entire path of the rail conveyor trucks, but is moved to-and-fro only over a small part of tnat path, corresponding to the timed movement of the rail conveyor trucks.

In one embodiment of the invention the couplings of the vacuum pipe of the rail conveyor trucks are connected to two evacuation pipes, one of which is coupled only when the rail conveyor trucks are stationary and the other during the timed movement of the rail conveyor trucks, to respective couplings. The use of two evacuation pipes provides the advantage that the vacuum pipe of the rail conveyor trucks is always connected to at least one evacuation pipe.

The two evacuation pipes are provided with a drive which permits displacement of the coupling elements of the evacuation pipes perpendicularly to the direction of movement of the rail conveyor trucks. The evacuation pipe participating in the displacement of the rail conveyor trucks is additionally provided with a drive which permits movement of the coupling element of the evacuation pipe parallel to the direction of movement of the rail conveyor trucks. The connection of the evacuation pipes to the couplings of the vacuum pipe of the rail conveyor trucks and their uncoupling are effected entirely automatically.

Each rail conveyor truck is provided with a control valve, by which the foundry molding box can be shut off from the vacuum pump. The valve may be controlled by means of electric or mechanical contacts. The purpose of this control valve is to shut off the foundry molding box from the vacuum pump of the rail conveyor trucks when the casting has cooled sufficiently to enable it to be removed from the mold. It is also conceivable for the control valve to be in the form of a two-way valve, so that the foundry molding box is supplied with air simultaneously with the sutting off of the vacuum supply thereto.

BRIEF DESCRIPTION OF THE DRAWINGS

The invention will now be described, by way of example, with reference to the drawings, in which.

DETAILED DESCRIPTION

Figure 1:
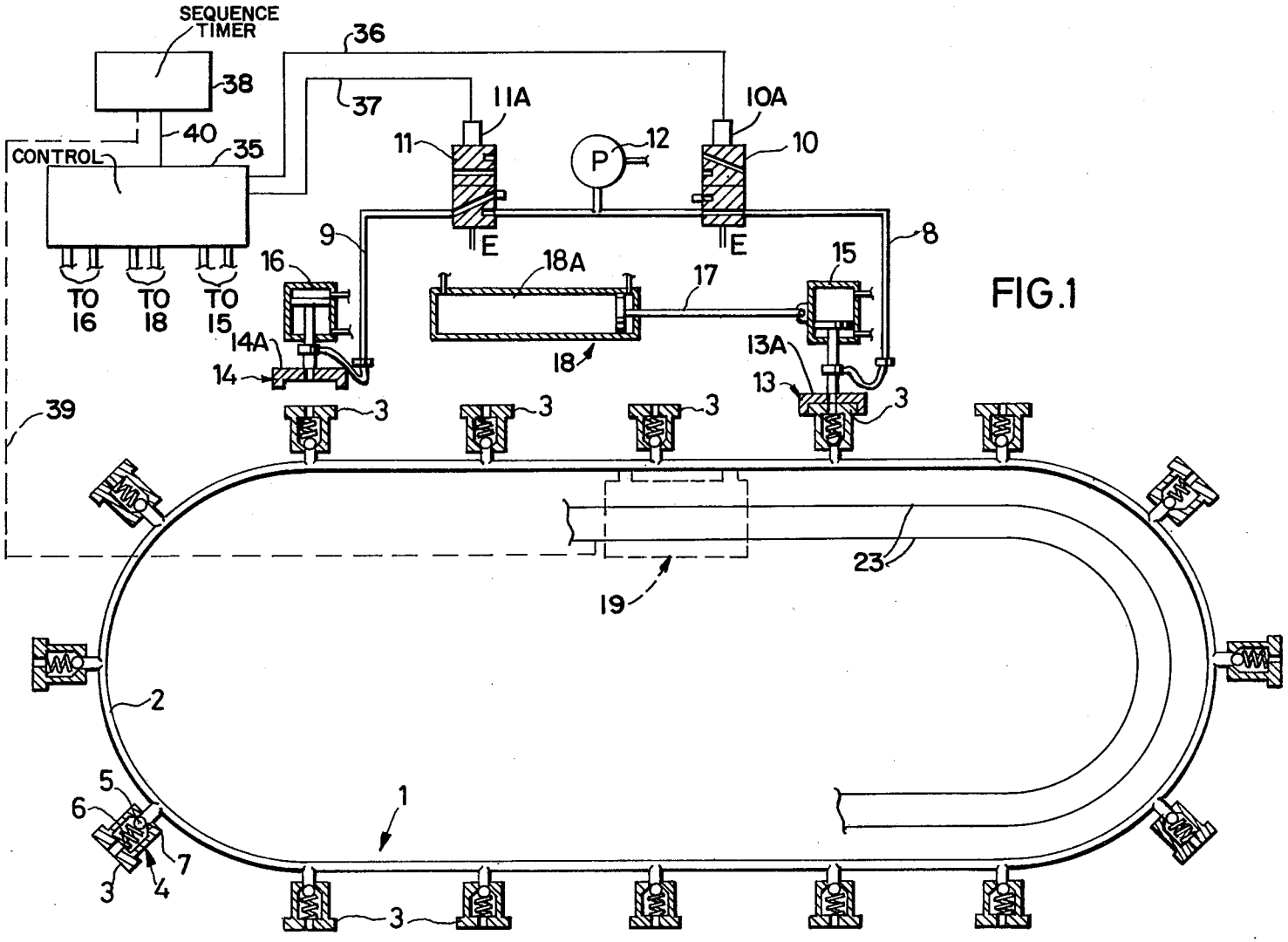
FIG. 1 diagrammatically illustrates a top view of a rail conveyor according to the invention.

In FIG. 1, the rail conveyor 1 is shown diagrammatically. For the sake of clarity the rail conveyor trucks are omitted and only the vacuum conduit or pipe 2 which connects the rail conveyor trucks together has been shown in this figure. The vacuum pipe 2 is provided at predetermined intervals with couplings or connector members 3 connected to the vacuum at their inner ends, each of which is normally closed by means of a non-return valve 4. Each non-return valve consists of a ball 5, which is pressed by a spring 6 against a sealing surface 7. The vacuum pipe 2 is in the form of a ring pipe.

For the evacuation of the vacuum conduit or pipe 2 use is made of two conduits or evacuation pipes 8,9, each of which is connected by way of a respective two-way valve 10,11 to a vacuum pump or source 12. Each valve 10,11 has a solenoid 10A,11A or the like coupled to a control 35 through control lines 36 and 37. Each of the evacuation pipes 8,9 is provided with coupling elements 13,14 having coupling heads 13A,14A respectively for connection to the outer ends of the connector members 3 of the vacuum pipe 2 of the rail conveyor trucks. Both coupling elements 13,14 have drive members 15,16, which move the coupling elements perpendicularly to the direction of movement of the rail conveyor trucks and the sequence of operation is controlled by the control 35. Each of the two drive members 15,16 consist of a double-action cylinder. The coupling elements are fastened to the piston rod of the cylinder. In addition, another drive mechanism 18 is provided which has a piston rod 17 of a double-action cylinder 18A which acts on the drive member 15 and serves to move the coupling element 13 parallel to the direction of movement of the rail conveyor trucks. The rail conveyor 1 is moved in timed sequence, each movement being equal to the distance between two successive connector members 3. The movability of the coupling element 13 parallel to the rail conveyor trucks also corresponds to the distance between two successive coupling elements 3.

Figure 2:
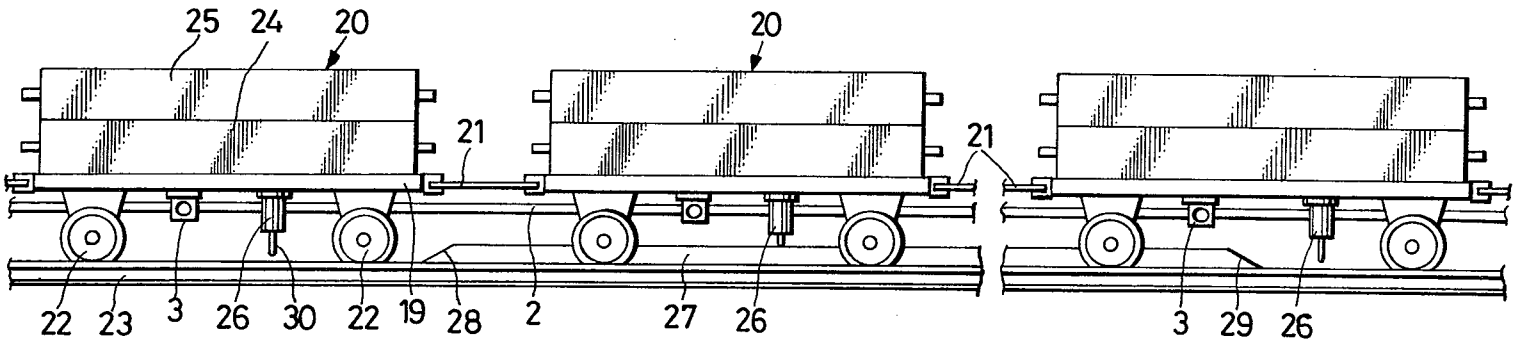
FIG. 2 is a side view of the rail conveyor trucks to an enlarged scale.

In FIG. 2,, which is a side view of the rail conveyor trucks 19 with foundry molding boxes 20 mounted on them, identical parts are given identical reference numbers. The rail conveyor trucks 19 run with their wheels 22 on rails 23 and are connected together by couplings 21. The foundry molding boxes 20 placed on the rail conveyor trucks consist of a lower box 24 and an upper box 25.

Control valves 26 are provided on each rail conveyor truck 19 and with their aid the vacuum pipes of the foundry molding box 20 can be shut off from thc vacuum pump 12 of the rail conveyor trucks. In the embodiment illustrated this shutting off is effected by a rail 27 disposed in the rail conveyor. The two ends 28,29 of the rail 27 are inclined, so that the operating pin 30 of the control valve 26 is lifted when it runs onto the rail, and thus operates the control valve 26.

OPERATION

The apparatus according to th invention works as follows:

When the lower box 24 is placed on the rail conveyor truck 19, the vacuum pipe of the lower box 24 is automatically connected to the vacuum pipe 2 of the rail conveyor by a device not illustrated. The upper box 25 is then placed on the lower box 24 and is likewise connected to the vacuum pipe 2 by a not illustrated structure. Further details of the structure of the boxes and the structure for connecting the vacuum between the boxes is illustrated and described in my copending application Ser. No. 538,794, filed Jan. 6, 1975, now Pat. No. 3,970,139 and reference is to be made thereto.

After the foundry molding box 20 has been placed in position, it is brought in timed sequence by the sequence timer 38 to the individual working stations by the rail conveyor 1. As already stated, two evacuation pipes 8,9, of which at least one is always connected to the vacuum pipe 2, serve to maintain the vacuum in the vacuum ring pipe 2. The sequence timer 38 simultaneously transmits signals through the lines 39 and 40 to the rails 23 and to the control 35. The signal transmitted to the rails 23 effects a periodic movement of the trucks 19 on the rails 23. When the signal transmitted through the line 39 effects a halting of the movement of the trucks 19, signals are transmitted from the control 35 to the two drive members 15,16. The time at which the signals are transmitted to the drive members 15,16 is controlled by the circuitry in the control 35. Referring to FIG. 1, when the rail conveyor trucks are stationary, the evacuation pipe 9 is connected by a coupling member 3 to the vacuum pipe 2 by effecting an energization of the drive member 16 to move the connecting head 14A into engagement with the coupling member 3. Thereafter, the control 35 energizes the solenoid 11A through the line 37 to shift the valve 11. The vacuum supplied by the pump 12 is thereafter connected to the evacuation pipe 9 to connect the vacuum pipe 2 through the connector member 3 and connecting head 14A. After a vacuum has been established through the coupling element 14, the control 35 effects an energization of the solenoid 10A to shift the valve 10 to disconnect the evacuation pipe 8 from the vacuum source 12. Thereafter, the control 35 energizes the drive member 15 to retract the connecting head 13A from engagement with the connecting member 3. Thereafter, the sequence timer 38 transmits a signal over the line 39 to the rails 23 to again effect a movement of the trucks 19 therealong. Simultaneous with this control procedure, the control 35 energizes a drive mechanism similar to the drive mechanism 18 to cause a movement of th coupling element 14 with the connector member 3 to which it is coupled. The control 35 energizes the drive mechanism 18 to retract the piston rod 17 and drive member 15 back to a starting position. The foregoing procedure is repeated in a step-by-step manner to always maintain a connection of the vacuum source 12 to the vacuum pipe 2.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In a rail conveyor apparatus, comprising:

a plurality of rail conveyor trucks coupled together and movably supported on a rail and at least one foundry molding box mounted on each rail conveyor truck, each of said foundry molding boxes having a vacuum connector member on said truck associated therewith, said connector member having inner and outer ends;

a vacuum source;

first conduit means for interconnecting said inner ends of said connector members to said vacuum source;

at least a pair of coupling elements;

second conduit means coupling said vacuum source to said pair of coupling elements;

valve means in said second conduit means for alternately connecting said coupling elements to said vacuum source;

coupling head means connected to at least one of said coupling elements for effecting a coupling of at least one of said coupling elements to said outer end of one of said connector members on one of said rail conveyor trucks prior to an uncoupling of the other of said coupling elements from said outer end of another connector member on another rail conveyor truck; and drive means connected to at least one of said pair of coupling elements for driving at least one of said pair of coupling elements in timed sequence with the movement of said rail conveyor trucks and said connector trucks and said connector members thereon whereby a vacuum is provided in said first conduit means for the period of time that said coupling head means couples said one coupling element to said one connector member so that said vacuum source is continuously maintained in coupled relation to said first conduit means.

2. A rail conveyor apparatus according to claim 1, wherein one of said coupling members is connected to one of said connector members only when said rail conveyor trucks are stationary and the other of the coupling members is connected to one of said connector members during a movement of said rail conveyor trucks in timed sequence.

3. A rail conveyor apparatus according to claim 1, wherein said coupling elements includes a first drive member for moving said coupling members into and out of coupling engagement with said connector members perpendicular to the direction of movement of said rail conveyor trucks.

4. A rail conveyor apparatus according to claim 3, wherein said drive means includes a second drive member for moving said one coupling member in timed sequence parallel to the direction of movement of said rail conveyor trucks.

5. A rail conveyor apparatus according to claim 1, wherein said second conduit means includes first and second conduits connecting said vacuum source separately to said pair of coupling members; and wherein said valve means includes first and second valve members each being coupled in one of said first and second conduits and being alternately operable to alternately connect said vacuum source to one of said pair of coupling members.

* * * * *

UNITED STATES PATENT AND TRADEMARK OFFICE

CERTIFICATE OF CORRECTION

PATENT NO. : 4 036 283

DATED : July 19, 1977

INVENTOR(S) : Herbert Grolla

It is certified that error appears in the above-identified patent and that said Letters Patent are hereby corrected as shown below:

Change address of inventor "Westphalia" to ---Westfalen---.

Change address of assignee "Westphalia" to ---Westfalen---.

Column 5, line 34; delete "trucks and said connector".

Signed and Sealed this

*First* Day of *November 1977*

[SEAL]

*Attest:*

RUTH C. MASON
*Attesting Officer*

LUTRELLE F. PARKER
*Acting Commissioner of Patents and Trademarks*